United States Patent [19]

Anderson, Jr.

[11] 4,220,438

[45] Sep. 2, 1980

[54] TWO WAY SIDE DUMP BUCKET ATTACHMENT FOR FRONT END LOADER

[76] Inventor: Harvey L. Anderson, Jr., 7706 Gifford Ct., Alexandria, Va. 22310

[21] Appl. No.: 7,199

[22] Filed: Jan. 29, 1979

[51] Int. Cl.[3] ..... B02F 3/70

[52] U.S. Cl. ..... 414/705; 298/17.6

[58] Field of Search ..... 414/705; 298/17.6, 17.7

[56] References Cited

U.S. PATENT DOCUMENTS 3,400,845 9/1968 Salna ..... 414/705

3,531,007 9/1970 Leijon ..... 414/705

*Primary Examiner*—Stephen G. Kunin

*Assistant Examiner*—George F. Abraham

*Attorney, Agent, or Firm*—Le Blanc, Nolan, Shur & Nies

[57] ABSTRACT

An improved two way side dump bucket attachment for an otherwise conventional front end loader having an arrangement for conventional bucket movement longitudinally of the loader. Unlatching of the bucket and lateral movement of the bucket to a selected side are accomplished simultaneously by activation of a single control.

10 Claims, 8 Drawing Figures

30
16
26
24
48
60
28
30
46
44
36
104
58
84
74
40
48
118
110
38
52
80
94
50
62
56
38
32
54
92
36
44
76
98
68
70
116
96
82
86
34
90
104
66
78
64
42
88
110
20
72
100
20
22
20
20
14
22

TWO WAY SIDE DUMP BUCKET ATTACHMENT FOR FRONT END LOADER

BACKGROUND OF THE INVENTION

This invention relates generally to dump buckets for front end loaders and more particularly to an improved, simplified assembly permitting lateral movement of the bucket to either side of the loader as well as conventional longitudinal movement for pick up of material and dumping.

The basic components of the instant invention include: a base or cradle which is mounted on the ends of the conventional, four point parallelogram linkage of a front end loader; a dump bucket; and an intermediate structure between the dump bucket and cradle which accomplishes lateral or sideways movement of the bucket through a maximum arc of about 80 degrees to either side of the cradle, which remains fixed in a plane laterally of the loader.

The cradle, intermediate structure and bucket are further positioned to be locked together for conventional, longitudinal movement of the bucket by means of the loader's conventional four point parallelogram linkage. For sideways movement, the intermediate structure is arranged to be simultaneously unlatched and activated from a single hydraulic control. Hydraulic fluid under pressure is provided from the usual hydraulics on the front end loader.

Presently, there is a one way side dump bucket assembly in general use but not of the numerous patented structures for a two way side dump bucket assembly has yet been found to be commercially practical or useful. One singular advantage of the one way side dump bucket assembly presently in use is that the hydraulics used for lateral shifting or swinging of the bucket include two hydraulic lines with a control valve to reverse flow in the lines, all being fed from the conventional hydraulics found on front end loaders. The instant invention utilizes this same very practical approach. On the other hand, previous, patented designs for two way side dump buckets have required separate hydraulics with complicated controls and/or latching mechanisms. In addition, the prior art structures have required delatching of one dump bucket end or the other from its main support or cradle without provision of sufficient stabilizing structure in the assembly to impart sufficient strength to the overall dump bucket in a side dump attitude. Furthermore, the prior art devices utilize but a single hydraulic cylinder at a time in shifting the dump bucket to one side or the other thus further weakening the overall system.

A representative sampling of prior art side dump buckets include the following prior patents. U.S. Pat. No. 3,022,910 discloses a two way side dump bucket, which I co-invented including a cradle mounted on the conventional, four point linkage of a front end loader, a dump bucket, and intermediate structure for shifting or rotating the bucket outwardly to either side for dumping. However, multiple pivots and an interconnecting strap assembly are required to impart sufficient strength to the assembly and no release or reengagement of the hydraulic jacks are provided when the loader bucket is in its conventional, lateral disposition. Further, only one of the two hydraulic jacks is used at a time for shifting the bucket to a side dump attitude. Another hydraulic lock only, multiple frame member and pivot asssembly for a side dump bucket is shown in U.S. Pat. No. 3,144,147. U.S. Pat. No. 3,198,358 discloses a mechanical latch arrangement in conjunction with a hydraulic jack assembly but only one of the two jacks is used at a time. Also, the multiple braces and pivots required are simply too weak to permit the device to withstand the rigors of heavy construction work.

Other side dump buckets employing dual hydraulic jacks arranged for use one at a time for dumping to one side or the other and requiring complete disengagement of one end of the dump bucket from its main support for lateral movement to a side dump position are disclosed in U.S. Pat. Nos. 3,268,101 (second embodiment—FIGS. 5–8); 3,531,007; and 3,885,694.

U.S. Pat. No. 3,207,342 illustrates a side dump bucket movable to one side only. Other disclosures of a single hydraulic jack for shifting the bucket selectively to either side but again requiring positive disengagement of one end of the dump bucket from its main support include U.S. Pat. Nos. 3,268,101 (first embodiment—FIGS. 1–4); 3,312,364; 3,203,565 (reissued as U.S. Pat. No. Re. 26,268); 3,400,845; 3,402,841; 3,419,171; 3,523,622; 3,531,007; and 3,532,241.

The economics of a practical, two way side dump bucket assembly are significant and indirectly evidenced by the above noted patent activity in recent years as others have sought a solution. In conventional operation of a front end loader, material is loaded into the bucket followed by reversal and rotation of the loader about 90 degrees so that the load may be dumped into a waiting dump truck (or other location). Then the loader must move back to its original attitude to scoop up another load of material. The time expense alone required in turning and shifting the loader from a pick up to a dump position is very high, to say nothing of the added maintenance and fuel expenses involved. Accordingly, the cost per cubic yard of earth or material removal by such a conventional methodology is extraordinarily high. Cost becomes even more critical a factor when work is done in very confined areas such as tunnel construction.

A practical two way side dump bucket structure for a front end loader will reduce construction work costs considerably as the need for turning and shifting the loader is eliminated. For example, in open trench work, a dump truck may be positioned parallel the loader. After a load is picked up by the front end loader, all that is needed is to lift and rotate the dump bucket sideways, then release the load into the waiting vehicle.

However, prior to the instant invention, a practical two way side dump bucket assembly has not existed. Prior art structures have lacked sufficient strength to withstand load forces in the side dump attitude. Most are not readily mountable on conventional front end loaders. Many require complex latches and/or valving arrangements subject to failure or fouling by debris when in use. It is the intent of the present invention to overcome the many problems of these prior art structures.

SUMMARY OF THE INVENTION

Accordingly, it is a principal object of the present invention to provide a two way side dump bucket assembly for an otherwise conventional front end loader having sufficient strength to withstand loading and dumping forces and stresses regardless of the attitude of the bucket.

It is another object of the invention to provide a two way side dump bucket having a bucket configuration whereby the sides are angled outwardly at about 35° and the bucket may be rotated through about an 80° arc to either side of a vertical plane drawn longitudinally through the loader to accomplish dumping.

It is a further object of the invention to provide a two way side dump bucket employing a pair of dual action hydraulic jacks simultaneously actuated to rotate the bucket in a predetermined direction for dumping; return of the bucket to a normal position and subsequent rotation of the bucket to the other side of the loader are accomplished by simple reversal of fluid flow in the hydraulic jacks, again simultaneously.

Still another object of the invention is to provide a two way side dump bucket assembly including a centrally mounted, two part stabilizing component for the bucket, a pair of hydraulic jacks to either side of the stabilizing component and a sliding control member beneath the stabilizing component which mechanically defines a swing left, swing right or neutral, bucket locked position, the control member being positioned by simultaneous actuation of both hydraulic jacks.

Still a further object of the invention is to provide a two way side dump bucket assembly with secure bracket assemblies on each end of the bucket for imparting sufficient strength to the overall structure even when the bucket is in a side dump attitude.

Yet another object of the invention is to provide a two way side dump bucket assembly which may be readily attached to a conventional front end loader or be made an integral part thereof which will greatly reduce cost per cubic yard of material moved.

Yet a further object of the invention is to provide a two way side dump bucket assembly which is of uncomplicated construction and whose components are protected from fouling by dirt and debris when in use.

Further novel features and other objects of this invention will become apparent from the following detailed description, discussion and the appended claims taken in conjunction with the accompanying drawings.

BRIEF DESCRIPTION OF DRAWINGS

A preferred structural embodiment of this invention is disclosed in the accompanying drawings in which.

DESCRIPTION OF THE PREFERRED EMBODIMENT

Figure 1:
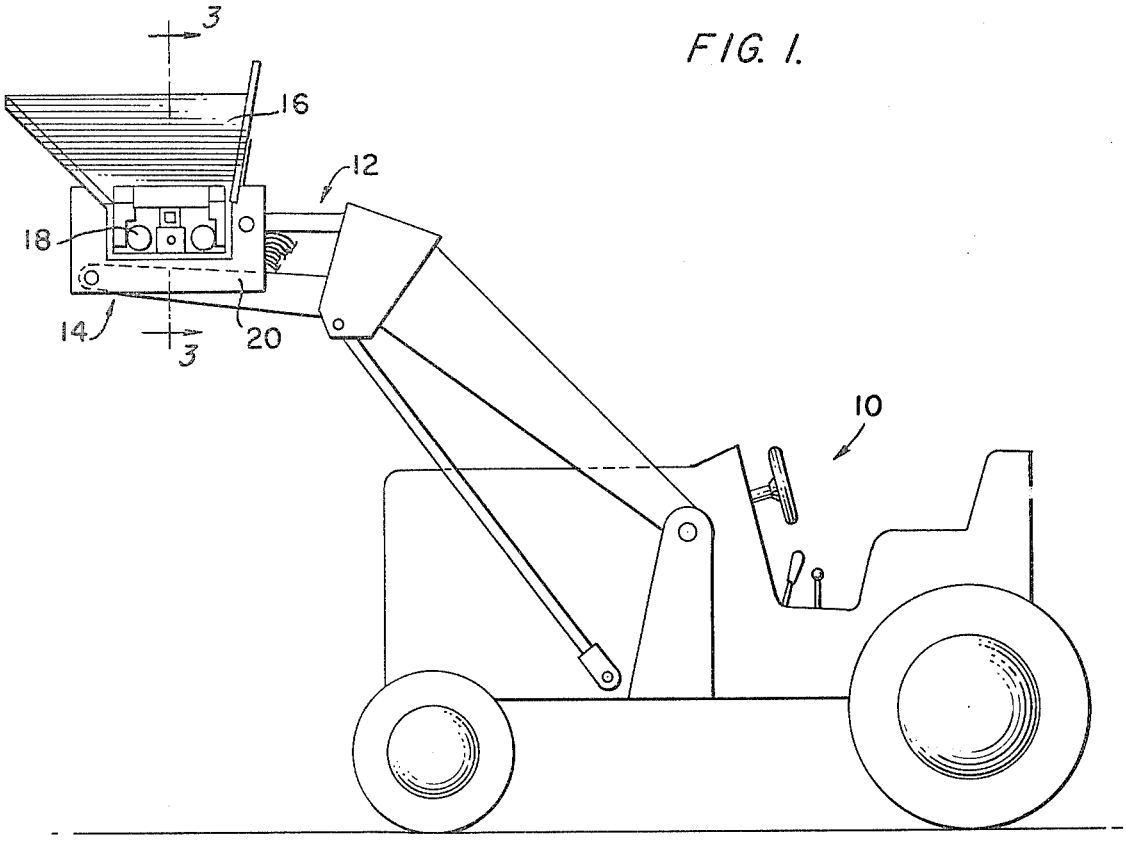
FIG. 1 is a side elevation view of the two way side dump bucket mounted on the four point, parallelogram lift linkage of a conventional front end loader.
Figure 2:
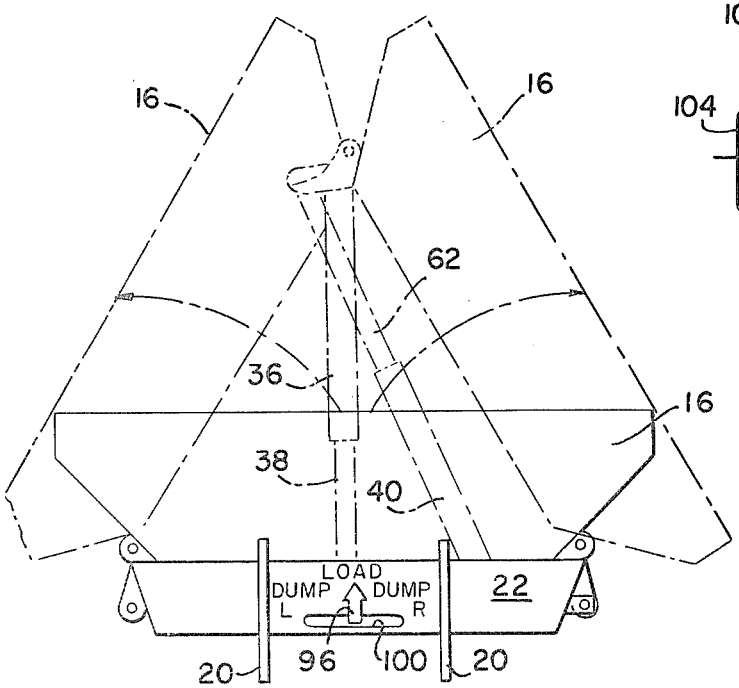
FIG. 2 is a top, generally schematic view of the dump bucket (or rear view, in the sense of FIG. 1), illustrating rotation of the bucket to either side through an arc of about sixty degrees, in phantom lines.

Referring now to the drawings by reference character and in particular to FIGS. 1 and 2 thereof, a conventional front end loader 10 is illustrated, having equally conventional, four point parallelogram lift linkage means 12 at the front end thereof. The subject matter of this invention, a two way side dump bucket assembly is attached to linkage means 12.

The dump bucket assembly includes three major components, these being cradle 14, dump bucket 16 and intermediate lateral control movement structure means 18 interconnecting cradle 14 and bucket 16.

Cradle 14 includes a pair of generally U-shaped support and linkage attachment brackets 20, 20 which are connected to linkage 12 as shown in FIG. 1. Thus conventional up and down, or scoop and dump motion of bucket 16 in a vertical plane drawn longitudinally through loader 10 is accomplished in a simply conventional manner by the usual controls provided in the front end loader (not shown). In addition, cradle 14 also includes top and bottom guard plates 22, 22 (FIG. 7) which serve to protect the components of the intermediate structure 18 from fouling by dirt and debris found at all construction sites.

Figure 3:
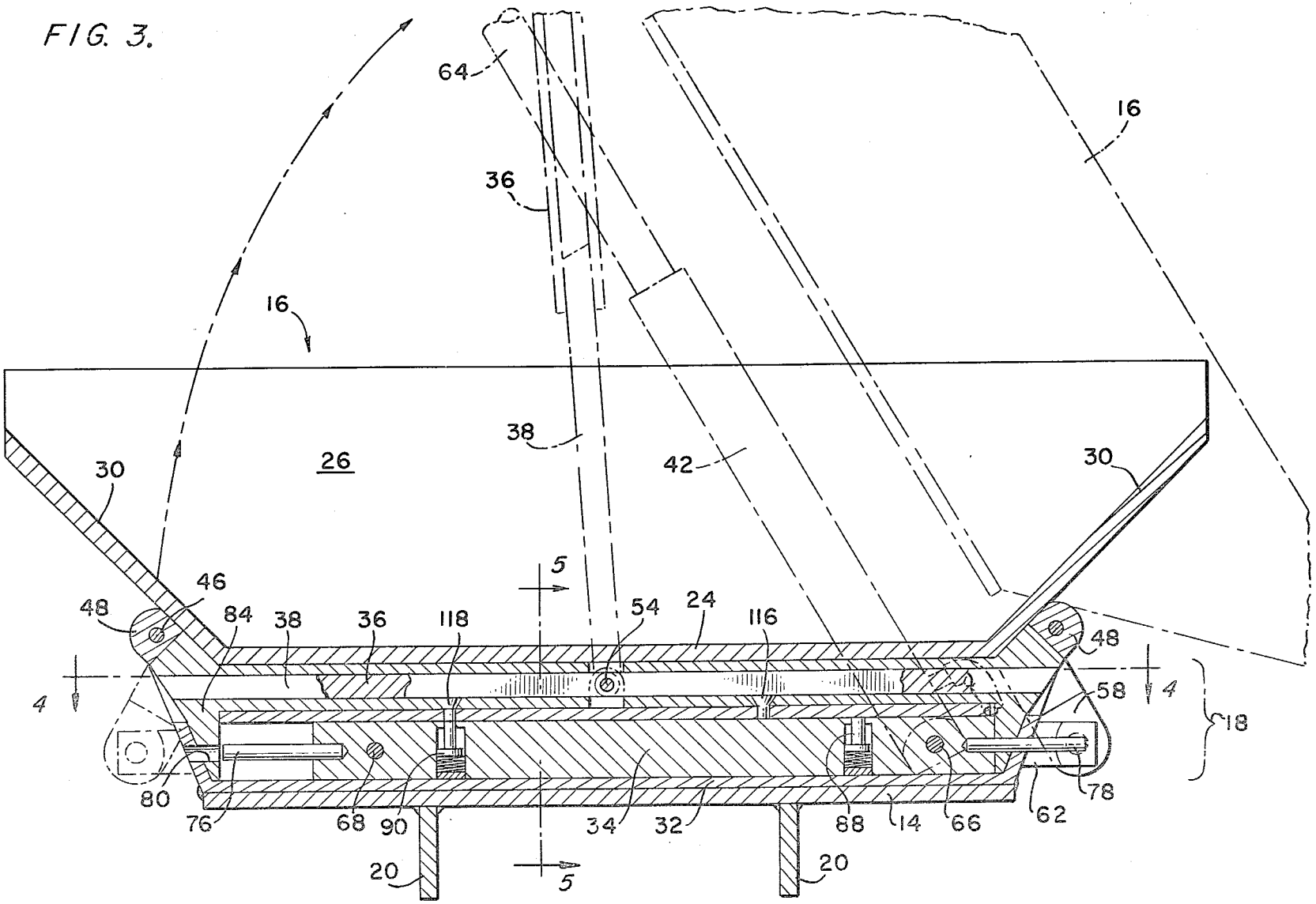
FIG. 3 is a section view taken along lines 3—3 of FIG. 1.
Figure 4:
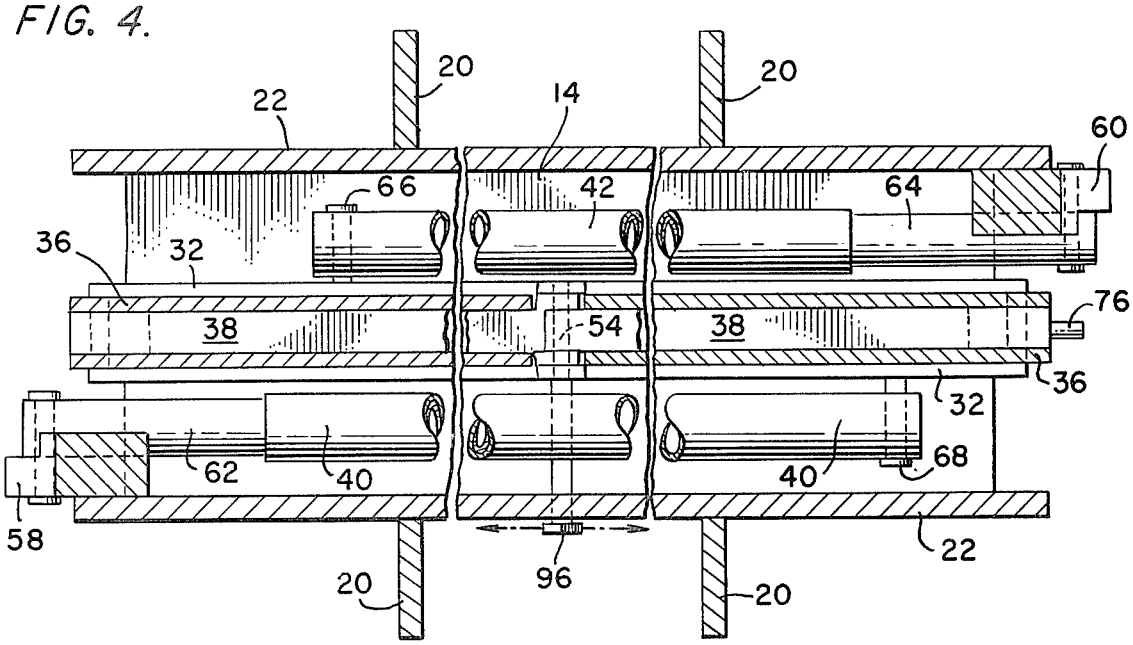
FIG. 4 is another section view taken along lines 4—4 of FIG. 3.
Figure 5:
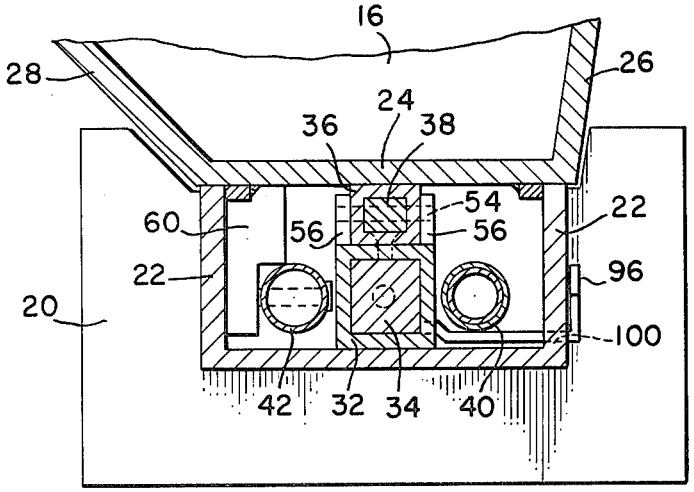
FIG. 5 is a further section view taken along lines 5—5 of FIG. 3.
Figure 7:
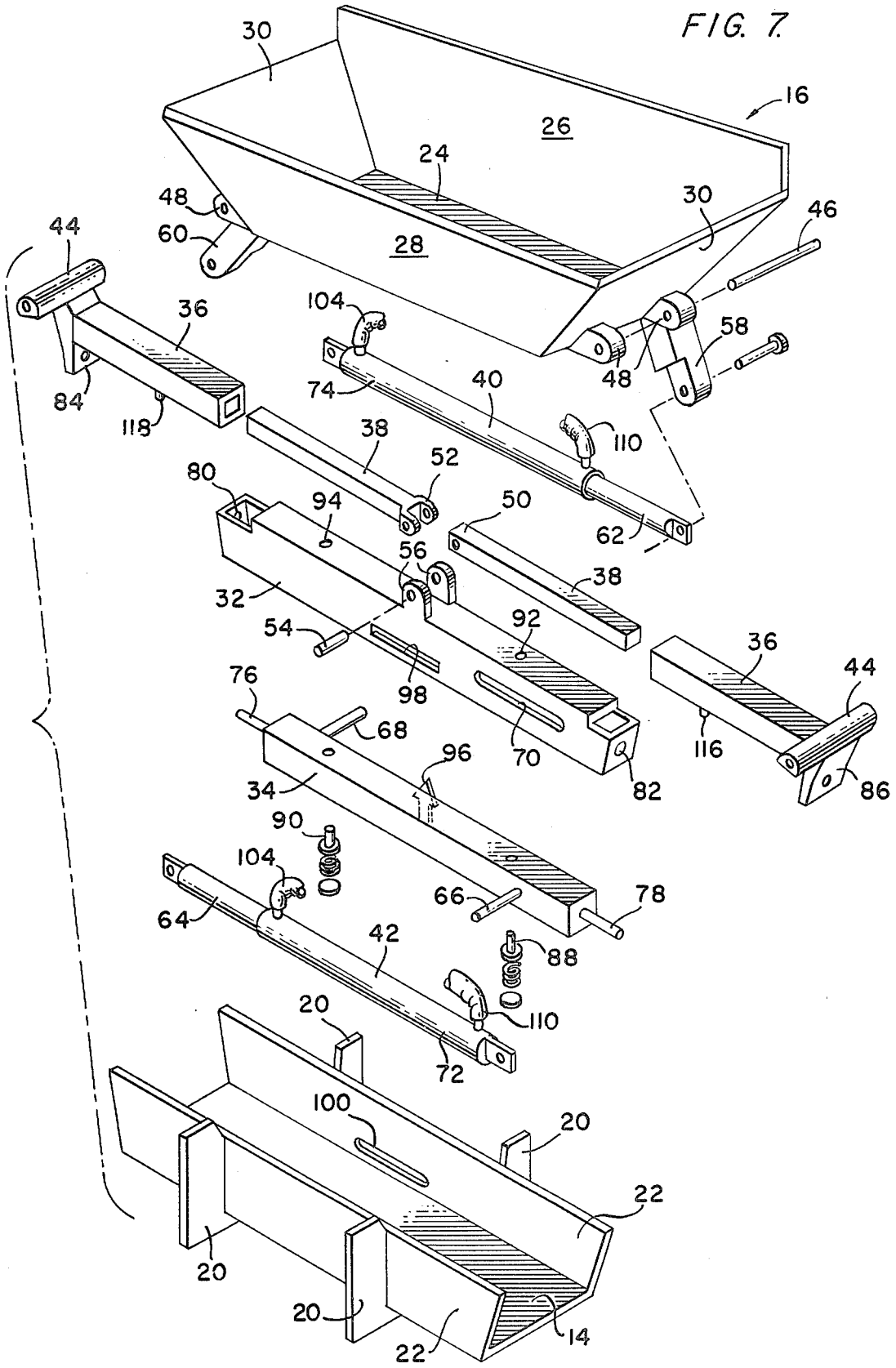
FIG. 7 is an exploded, perspective view illustrating the components of the dump bucket and supporting structure.

Referring to FIGS. 3 and 7, dump bucket 16 has a rear wall 24, a top plate 26, an angled scoop or bottom plate 28 and side chutes 30, 30, each angled outwardly from rear wall 24 at about 35°. Chutes 30, 30 are so angled to retain loose materials and for obtaining maximum reach to either side of the loader during pickup of material. Bottom plate 28 is angled as shown so that when dump bucket 16 is in a maximum, downwardly rotated dump position, bottom plate 28 will be disposed at an angle of about 80° with respect to a horizontal plane to thereby assure complete discharge of all materials.

Further referring to FIG. 7, the intermediate lateral movement control structure means 18 includes an extended length control member housing 32, which is securely fixed to cradle 14, a control member 34 slidable within housing 32 between fixed limits of movement as will be described below, a multi-section, telescoping stabilizing assembly including base members 36, 36 and extensions 38, 38, and a pair of dual action, piston cylinder fluid motors or hydraulic jacks 40, 42, arranged generally parallel to and to either side of housing 32.

Each base member 36 has an intermediate bracket 44 at its outer end, pinned at 46 for pivotal mounting within bracket 48 at an end of the rear wall 24 of bucket 16. This structure provides a stable, strenghtened relationship of parts in that, in contradistinction to the prior art, the ends of bucket 16 are never detached from their support structure during rotation of the bucket to a side dump position.

Extensions 38 are slidable within their respective bases 36 and are pivotally attached at their meeting ends 50, 52 by a pin 54 through upstanding ears 56, 56 centrally located on housing 32.

Each bucket bracket 48 also includes a bracket extension 58, 60 for mounting piston rod 62 of jack 40 and piston rod 64 of jack 42, respectively. Control member 34 has opposed, laterally extended hydraulic jack mounting pins 66, 68, extended through slots formed in housing 32, one of which is shown at 70, for pivotal mounting of the base of cylinder 72 of jack 42 and the base of cylinder 74 of jack 40, respectively.

Sliding control member 34 also has a pair of end control extensions 76 and 78 which are selectively inserted through end bores 80 and 82, respectively, of housing 32 for further engagement with matingly through bored lock tabs 84 and 86, respectively, formed as a part of brackets 44 of the telescoping stabilizing assembly.

As hereinbefore stated, control member 34 is slidable within fixed limits of travel and these are further controlled, as will be explained below, by a pair of spring loaded stop pins 88, 90, selectively engaging housing stop bores 92 and 94 respectively. (Pins 88, 90 may be gas loaded or otherwise suitably automatically actuated to serve their intended function as will be described in further detail below).

A direction indication pointer 96 may be provided on control member 34; it extends through a slot 98 in housing 32 and a mating slot 100 in plate 22 of cradle 14 to externally, visually indicate a neutral, locked condition of "load" or a "dump L" or "dump R" attitude as illustrated in FIG. 2.

Figure 8:
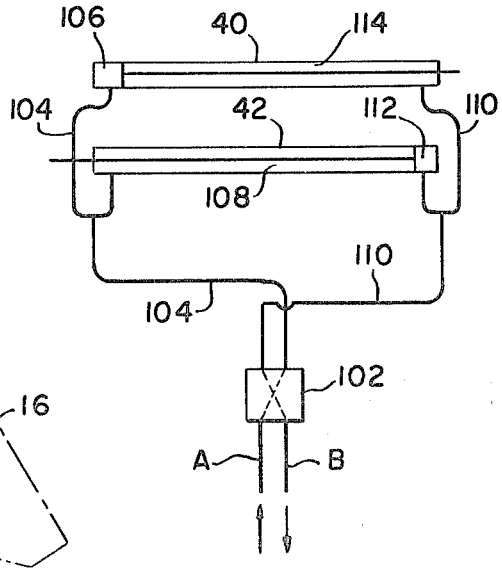
FIG. 8 is a schematic diagram of the hydraulics and control valve of the invention.

Turning now to FIG. 8, the hydraulic controls of the invention will be discussed. The basic machine hydraulics of a conventional front end loader include a fluid under pressure line A and a return line B. These are directed through a simple reversing control valve 102 to line 104 and the piston head end 106 of jack 40 and behind piston head end 108 of jack 42, and to line 110 and the piston head end 112 of jack 42 and behind the piston head end 114 of jack 40.

In each case where pivotal connections via pins were above mentioned, suitable bushings, bearings, etc. might be used according to standard, well known engineering principles.

Figure 6:
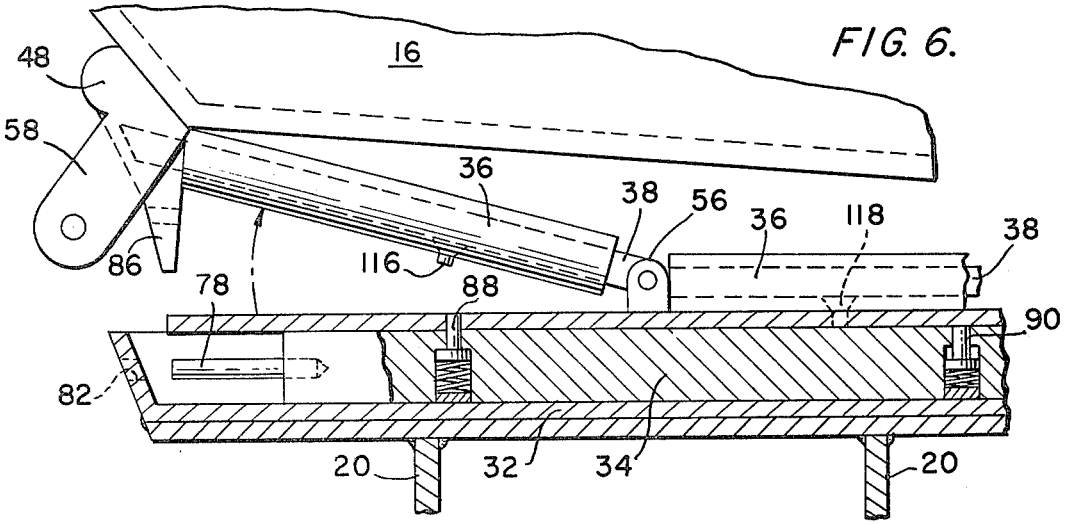
FIG. 6 is a partial rear view, taken from the right hand side of FIG. 5, partly in plan and partly in section showing relationship of parts as a "dump right" attitude movement is initiated.

Now with reference to the remaining drawing figures, the operation of the invention will be discussed. It will be noted that simple actuation of control valve 102 only accomplishes all the operation features of the invention. When the operator activates valve 102 to a "dump right" attitude, fluid under pressure is introduced through line 104 to oppositely arranged jacks 40 and 42, simultaneously causing jack 40 to extend and jack 42 to contract. (Ordinarily, such a valve 102 is provided as an optional control with the front end loader. Such a valve is easily installed if the loader is not so equipped.) Thus control member 34 is caused to slide to the right (with reference to FIG. 6) and end extension 78 withdraws from tab 86 and bore 82 to thus free the left end of bucket 16 for pivotal movement about its right end. When control member 34 reaches the right hand end of housing 32, continued extension of jack 40 and retraction of jack 42 will cause the disengaged left end of bucket 16 to rotate outwardly. Now, at this time, stop pin 88 is located directly beneath a stub pin 116 located on the bottom of base 36 (FIG. 6). (A similar stub pin 118 is located on the other base 36). As bucket 16 rotates, as shown in FIG. 6, stub pin 116 disengages from stop bore 92 and spring loaded stop pin 88 engages bore 92 to lock control member 34 in the illustrated position. Continued actuation of jacks 40, 42 causes bucket 16 to rotate outwardly as shown in phantom lines in FIG. 2 to the right. The control valve 102 is then moved to a neutral position to stop outward rotation when desired.

The conventional controls for linkage 12 (not shown) are then actuated to dump a load of material from bucket 16.

Thereafter, control valve 102 is actuated to reverse flow to jacks 40, 42 so that now jack 40 retracts and jack 42 extends. This will cause bucket 16 to return to its initial position within cradle 16. During this movement, stop pin 88 locks control member 34 in the disposition shown in FIG. 6 so it will not move during bucket return.

Now, as the bucket returns to its initial position stub pin 116 reenters stop bore 92 and depresses pin 88 out of engagement with bore 92. This now frees control member 34 so that it may slide to the left.

further movement of control member to the left will cause the pointer 96 to move to the "Load" position illustrated in FIG. 2. At this point, both extensions 76 and 78 will be engaged with tabs 84 and 86 and thus the bucket 16 will be locked within the cradle so that a subsequent loading operation may proceed.

In the event a "dump left" maneuver is desired, the operation proceeds as described above, but oppositely in that jack 40 is retracted while jack 42 is extended, to withdraw extension 76 from tab 84. Bucket 16 is now freed at its right end, to rotate outwardly about its left end, with reference to FIG. 6. The relationship of parts during a "dump left" maneuver is clearly illustrated in FIG. 3. Since the remainder of the operation parallels a "dump right" maneuver, it will not be further described.

Each half of the stabilizing assembly (base 36 and extension 38) may be made of multiple sections, if needed for stability in a broad reach attitude. Additionally, multiple jacks 40, 42 and/or multiple housings and control members 32 and 34, respectively, may be employed, particularly in large, heavy assemblies.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. For use as an attachment to a front end loader having controlled linkage means for movement of a dump bucket in a plane drawn vertically, longitudinally through the loader, a dump bucket assembly for moving said dump bucket laterally of said vertical, longitudinal plane and to either side thereof comprising: a cradle mounted on the loader linkage means; a dump bucket arranged on said cradle means; and intermediate lateral movement control structure means interconnecting said cradle and dump bucket comprising a horizontally arranged, extended length housing affixed centrally on said cradle, a multi-sectioned, telescoping stabilizing assembly overlying said housing and pivotally interconnected therewith centrally of said housing, bracket means on said bucket for interconnection with the distal ends of said stabilizing assembly, a sliding control member within said housing arranged for fixed limits of travel therewithin, a pair of dual action piston cylinder fluid motors arranged alongside said housing, each said motor having one of its ends pivotally connected through said housing to said control member and its other end pivotally connected to one of said bucket bracket means, a pair of direction control extension means on the ends of said control member, extended through the ends of said housing for selective engagement with one or the other of the bracket means, and a source of fluid under pressure for said motors, said motors being oppositely arranged whereupon selective introduction of fluid under pressure against the piston of one motor and behind the piston of the other motor, said control member is moved within said housing to engage one of said pair of direction control means with a selected bracket means and to disengage the other of said pair of direction control means with the other bracket means to thereby cause said bucket to rotate laterally outwardly about a preselected one of said bucket bracket means.

2. The front end loader dump bucket assembly as claimed in claim 1 wherein said control member and housing further comprise means for controlling travel of said control member within said housing.

3. The front end loader dump bucket assembly as claimed in claim 2 wherein said travel controlling means comprise a pair of spring loaded pins mounted within said control member and a pair of mating bores located within said housing, said pins being offset from said bores for non-simultaneous engagement therewith.

4. The front end loader dump bucket assembly as claimed in claim 2 wherein said stabilizing assembly further comprises means for selectively disengaging said control member travel controlling means.

5. The front end loader dump bucket assembly as claimed in claim 1 wherein said intermediate lateral movement control means are arranged to rotate said loader bucket in either direction through an arc of about 80°.

6. The front end loader dump bucket assembly as claimed in claim 1 wherein said cradle includes means for visually indicating the direction of rotation of said dump bucket.

7. The front end loader dump bucket assembly as claimed in claim 1 wherein said control member is arranged within said housing to selectively engage both of said direction control extension means with their respective bracket means.

8. The front end loader dump bucket assembly as claimed in claim 1 wherein said dump bucket brackets for mounting said stabilizer assembly each further comprises a bracket extension therefrom for mounting an end of one of said motors.

9. In combination with a front end loader having controlled linkage means for movement of a dump bucket in a plane drawn vertically, longitudinally through the loader, a dump bucket assembly for moving said dump bucket laterally of said vertical, longitudinal plane and to either side thereof comprising: a cradle mounted on the loader linkage means; a dump bucket arranged on said cradle means; and intermediate lateral movement control structure means interconnecting said cradle and dump bucket comprising a horizontally arranged, extended length housing affixed centrally on said cradle, a multisectioned, telescoping stabilizing assembly overlying said housing and pivotally interconnected therewith centrally of said housing, bracket means on said bucket for interconnection with the distal ends of said stabilizing assembly, a sliding control member within said housing arranged for fixed limits of travel therewithin, a pair of dual action piston cylinder fluid motors arranged alongside said housing, each said motor having one of its end pivotally connected through said housing to said control member and its other end pivotally connected to one of said bucket bracket means, a pair of direction control extension means on the ends of said control member, extended through the ends of said housing for selective engagement with the adjacent bracket means, and a source of fluid under pressure for said motors, said motors being oppositely arranged whereupon selective introduction of fluid under pressure against the piston of one motor and behind the piston of the other motor, said control member is moved within said housing to engage one of said pair of direction control means with a selected bracket means and to disengage the other of said pair of direction control means with the other bracket means to thereby cause said bucket to rotate laterally outwardly about a preselected one of said bucket bracket means.

10. A dump bucket attachemnt for an otherwise conventional front end loader having front linkage means thereon for conventional raising and lowering of a dump bucket in a plane drawn longitudinally through the loader, said attachment comprising: a cradle base, adapted for attachment to the loader linkage means; a dump bucket; and intermediate structure means interconnecting said cradle and dump bucket for rotating said bucket laterally outwardly to either side of the longitudinal plane drawn through the loader, said intermediate structure means including: a stabilizing assembly fixed onto the cradle and having distal ends attached to the respective ends of the dump bucket on the bottom side thereof and a central section pivotally attached centrally of the cradle, said stabilizing assembly thus being divided into two sections, each section having a plurality of extensible members; a pair of dual action fluid piston cylinder motors arranged on the cradle alongside said stabilizing assembly and being oppositely disposed whereupon introduction of fluid under pressure simultaneously into said motors, said bucket is caused to swing laterally outwardly about one of said dump bucket ends; and control means associated with said bucket ends and mounted on said cradle beneath said stabilizing assembly and selectively actuated by introduction of fluid under pressure into said motors to lock both said bucket ends to said cradle and to release one or the other of said bucket ends from said cradle to permit lateral outward movement of said bucket about a preselected one of said bucket ends.

* * * * *